US006689994B2

(12) United States Patent
Reichelt

(10) Patent No.: US 6,689,994 B2
(45) Date of Patent: Feb. 10, 2004

(54) ANTENNA RADIATION HEATER FOR HEATING A MATERIAL BY USING RESONANCE

(75) Inventor: Helmut Reichelt, Dresden (DE)

(73) Assignee: Moletherm Holding AG (CH)

( * ) Notice: Subject to any disclaimer, the term of this patent is extended or adjusted under 35 U.S.C. 154(b) by 0 days.

(21) Appl. No.: 10/333,558

(22) PCT Filed: Jun. 1, 2001

(86) PCT No.: PCT/EP01/06239

§ 371 (c)(1),
(2), (4) Date: Jan. 22, 2003

(87) PCT Pub. No.: WO02/10650

PCT Pub. Date: Feb. 7, 2002

(65) Prior Publication Data

US 2003/0155348 A1 Aug. 21, 2003

(30) Foreign Application Priority Data

Jul. 29, 2000 (DE) ..... 100 37 027

(51) Int. Cl.[7] ..... H05B 6/02; H05B 6/64

(52) U.S. Cl. ..... 219/634; 219/749; 219/736; 361/1

(58) Field of Search ..... 219/634, 678, 219/679, 728, 729, 759, 730, 702, 715, 748, 736; 361/1, 107, 108

(56) References Cited

U.S. PATENT DOCUMENTS 4,186,294 A 1/1980 Bender ..... 219/527
4,931,625 A * 6/1990 Marlinski ..... 219/528
6,444,962 B1 * 9/2002 Reichelt ..... 219/634

FOREIGN PATENT DOCUMENTS

| | | | |
|---|---|---|---|
| DE | 208 029 | 3/1984 | ..... H05B/6/72 |
| DE | 3621 108 C2 | 5/1990 | ..... H05B/6/72 |
| FR | 84 19587 | 11/1986 | ..... F24D/13/00 |
| WO | WO 00 25552 A | 5/2000 | ..... H05B/6/64 |

* cited by examiner

*Primary Examiner*—Philip H. Leung
(74) *Attorney, Agent, or Firm*—McNair Law Firm, P.A.

(57) ABSTRACT

Disclosed is an antenna radiation heater (2) to heat material using molecular resonance. A plurality of surface antenna elements (3), each having a carrier surface material (11) and a radiation coating (10) applied thereon are connected by two spaced apart electrical conductors (14, 15) in parallel, with electrical contacts as antenna limiters and with which high-frequency electromagnetic radiation can be emitted. The antenna (2) includes a harmonic generator, coupled to electrical conductors (14, 15) of element (3) for excitation of the coating (10) for emitting an oscillation spectrum within the range of natural molecular frequencies of the material being heated. The radiation coating (10) is unilaterally applied to the carrier material (11) and forms an element front facing the material being heated. A contact protection layer (12) is applied to the radiation coating (10) which electrically insulates the radiation coating (10) against contact and also permits the emission of the oscillation spectrum without or at most with only minor attenuation.

10 Claims, 2 Drawing Sheets

ANTENNA RADIATION HEATER FOR HEATING A MATERIAL BY USING RESONANCE

REFERENCE TO PRIORITY APPLICATION

Figure 1:
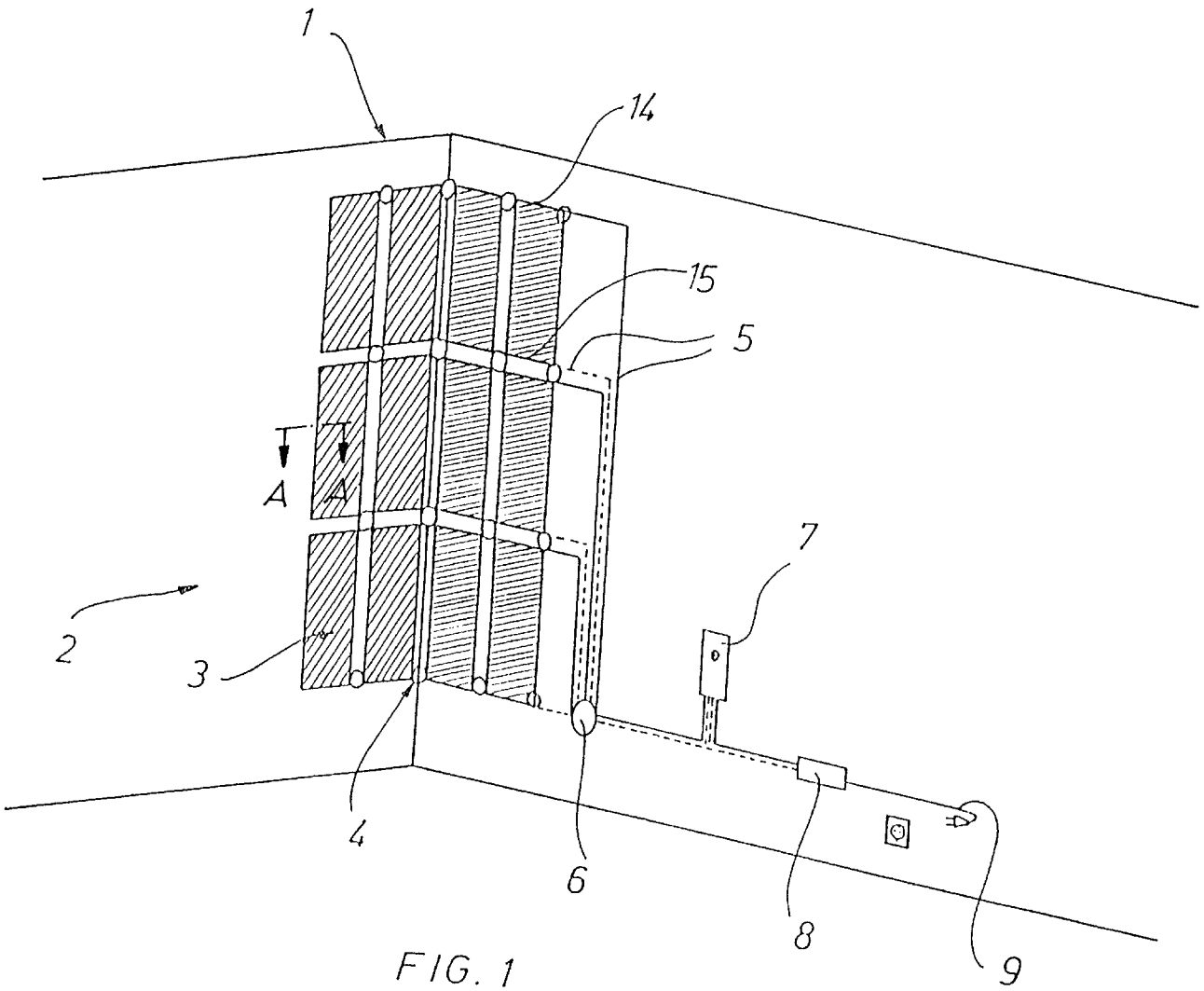

This application claims priority from German application serial number 100 37 027.6 filed Jul. 29, 2000 which is also the priority application for PCT/EP01/06 239 filed Jun. 1, 2001.

FIELD OF THE INVENTION

The invention relates to an antenna for resonance heating of material.

BACKGROUND OF THE INVENTION

A known antenna for radiation heating of material using resonance or harmonic excitation is disclosed in WO00/25552 entitled "Heating Arrangement" having a priority date of Oct. 27, 1998. The arrangement is made up of several surface antenna elements each of which consists of a carrier surface material and a radiation coating applied thereto that is delimited by means of two spaced, parallel electrical conductors having electrical contacts as antenna limiters. With this radiation coating, high-frequency electromagnetic radiation can be emitted from the antenna. Moreover, the process of heating by radiation from an antenna requires a harmonic generator that is coupled to two electrical conductors on the antenna surface element for excitation of the radiation coating so that an oscillatory spectrum within the range of the natural molecular frequencies of the matter to be heated can be emitted. Furthermore, a suitable radiation coating is specified in the foregoing disclosure, which generates a suitable radiation spectrum with the described excitation. In addition, a multiple arrangement of surface antenna elements is disclosed such that in a corner of a room twelve rectangular surface antenna elements—four, each side by side, in three vertically positioned rows—are arranged with small spacings and are electrically connected in parallel. The electromagnetic waves are created by means of a harmonic generator.

It has been shown that for the efficient heating of a room, for example, the surface antenna elements should have a relatively large area, the individual surfaces not being randomly enlargeable since the heating effect would then be reduced again. Accordingly, it is expedient to use the specified or a similar multiple arrangement of surface antenna elements. Control of the electrical supply wires is in the low voltage range, e.g. about 24 volts. Thus, in operation the relatively cool radiation coating of a surface antenna element can be touched without the risk of electric shock, i.e. touching is entirely non-critical. Surprisingly, however, it has been found that considerable potential differences may occur between the surface antenna elements of a multiple arrangement. In parallel connections, this might be due to the phase shifts of the oscillatory spectrums of the individual surface antenna elements. In the event that several surface antenna elements are within reach of a technician or a heating user, there is thus the risk of electric shock if two or more surface antenna elements are simultaneously touched. Although such electric shock is, as a rule, not dangerous or hazardous to health, it may be an extremely unpleasant experience. Until now, this problem has not been recognized within the state of the art and has not been described either. Accordingly, it is one object of the invention to develop basic heating by antenna radiation so that the risk of electric shocks is virtually eliminated. The foregoing objects are realized by the invention summarized below:

SUMMARY OF THE INVENTION

Briefly, the invention is an antenna radiation heater for heating material using resonance comprising a plurality of antenna elements, each having a carrier surface material and a radiation coating applied thereon which is delimited by two spaced parallel electrical conductors with electrical contact as antenna limiters and from which high-frequency electromagnetic radiation can be emitted; a harmonic generator coupled to the two electrical conductors of a surface antenna element for excitation of the radiation coating for the emission of an oscillation spectrum within the range of the natural molecular frequencies of the matter to be heated; and a radiation coating applied unilaterally onto the carrier surface material to form an element front facing the material heated and a contact protection layer applied on the radiation coating against contact which also permits the emission of the oscillation spectrum without any or at most with only minor attenuation.

In a further explanation of and first aspect of the invention, radiation coating is applied on one side on the carrier surface material and forms the first of the elements facing the material to be heated. Furthermore, a contact protection layer is applied to the radiation coating. The material of such a contact protection layer preferably is selected such that, on the one hand, the radiation coating is electrically insulated against contact and, on the other hand, the emission of the oscillatory spectrum is possible without any or at least only minor attenuation. The two properties of the radiation coating that are essential in this combination are that the coating acts as an electrical insulation layer to avoid electric shocks upon touching two elements, and that the coating allows for attenuation-free radiation or, at least, low-attenuation of the emission of the oscillatory spectrum.

According to a second aspect, the carrier surface material as the element's reverse side should preferably also have electrical insulation properties; however, as opposed to the contact protection layer, it should either entirely or at least significantly attenuate the emission of the oscillatory spectrum. This will be achieved in that the radiation energy as a whole or at least a major part of it will be emitted via the element front which will result in a particularly energy saving heating of the material.

A suitable contact layer, according to a third aspect of the invention, having the above specified properties, may consist of an aqueous, finely dispersed, softener-free, medium viscosity copolymer dispersion of acrylic and methacrylic acid esters which advantageously has a solids concentration of approximately 50% and an average particle size of approximately 0.1 $\mu$m.

Alternatively, a suitable contact layer according to a fourth aspect of the invention may consist of an aqueous, protective colloidal, medium viscosity polymer dispersion of vinyl acetate, versatic acid, vinyl ester and maleic acid di-n-butyl ester, advantageously having a solids concentration of approximately 50–55% and an average particle size of approximately 0.2 $\mu$m.

The coating material of the radiation coating can be selected in a manner known in the art in accordance with the composition of a fifth aspect of the invention. The specified sulfonated oil here preferably consists of sulfonated ricinus oil and the specified phenols are advantageously carbonized phenols produced by cracking, or benzisothiazolinone is used. As a thinning agent, a solvent based on aromatics and/or alcohol and/or ester and/or ketone has proven to be advantageous whereas an inorganic and/or organic, monomeric and/or polymeric substance is particularly suitable as a dispersing agent. Insulating soot is suitable as an insulator, and the coating material should contain a thixotropy agent.

The radiation coating and the contact protection layer can be applied and produced by methods known per se. According to a sixth aspect, the radiation coating and/or after its firming up, the contact protection layer are produced, especially advantageously, by means of blade spreading. In particular, the amount of casein or, possibly, of polyacrylates in combination with a blade spreading method cause a radiation attenuation toward the element's reverse side, especially if the radiation coating is applied to paper material. The contact protection layer is also expediently produced by blade spreading, with layer gauges of approximately 5–10 $\mu$m regularly being sufficient for contact protection and, at that, still not causing any unfavorable attenuation of emission on the element's front side.

In a manner known to those skilled in the art, a suitable excitation of the radiation coating according to a seventh aspect of the invention is possible such that the harmonic generator as a component of a control/regulating device comprises an electrical element which—upon control with a control oscillation—shows a steep current speed increase in accordance with a steep rising curve and thus is suitable for producing a high harmonic proportion. The electrical element may be, for example, a Triac (bi-directional triode thyristor) or Doppel-MOS FET (Double metal onide-semiconductor-fill-effect-transitor) with the allocated electronic control components known to those skilled in the art. The resonance arrangement takes the required energy as needed from the connected electrical network, with the heating effect being at least partly controllable and/or adjustable by changing the amplitudes and/or the frequency of the oscillator control.

According to an eighth aspect, it is expedient to design the electrical conductors in a conventional manner as copper foil strips arranged in parallel. A covering of copper foil strips as known in the art as antenna limiters with an electrical insulating layer (see, for example, German Patent document DD 208 029) can also be realized. The electrical contact to the radiation coating is designed as a capacitive and/or inductive coupling.

The indicated contact protection is especially essential if, according to a ninth aspect, the multiple antenna surface elements are arranged within mutual reach, electrically connected in parallel and excitable by means of a harmonic generator. Even if several harmonic generators are used for the antenna surface elements, there is the risk of an electric shock due to the above-mentioned potential differences so that a contact protection with an electrical insulation layer is essential here as well.

A compact, visually pleasing arrangement results, according to a tenth aspect of the invention, if all antenna surface elements have an identical right-angled surface and are connected in parallel in a symmetrical arrangement with short lengths of supply lines.

IN THE DRAWINGS

Figure 2:
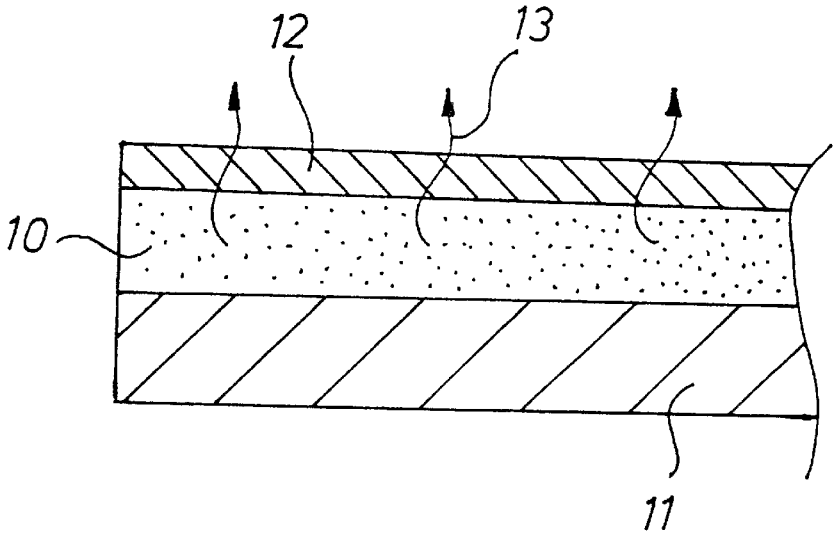

The invention is described in more detail by way of the drawings, which are attached hereto by way of illustration and not by way of limitation. In the drawings:

FIG. 1 is a perspective representation of the antenna for radiation heating of material for space heating, according to the invention; and FIG. 2 is a schematic cross-sectional view along line A—A of FIG. 1.

DETAILED DESCRIPTION

FIG. 1 is a perspective representation of a corner of a room 1 in which an antenna radiation heater 2 is installed. The antenna radiation heater 2 here consists, by way of example, of a combination of twelve surface antenna elements 3 which are symmetrically grouped in horizontal rows of four surface antenna elements 3 in room comer 1.

Here the surface antenna elements 3 are designed as right-angled surface elements and are each connected on their narrow sides with each other in connecting points 4 as parallel connections. Three vertically spaced surface antenna elements 3 are each connected by connection cable 5 via a distributor box 6 and with the other surface antenna elements 3 and, respectively, their electrical conductors 14, 15 as copper foil strips via the parallel connections 4.

A control device 7 contains, in particular, a harmonic generator, which in turn comprises an electrical element, which upon control with a control oscillation shows a steep rate of current increase in accordance with a steep rising edge and thus is suitable for generating a high harmonic percentage. Such an electrical element may be, for example, a Triac or a double MOS FET, which have the electronic control components known in the art. The control device 7 is, on the one hand, connected via distributor box 6 with the surface antenna elements 3 and, on the other hand, is supplied via a transformer 8 via a power supply connection 9.

As is especially evident from FIG. 2 which shows a schematic partial sectional view along line A—A of FIG. 1, the surface antenna elements 3 each consist of a carrier surface material 11 and a radiation coating 10 applied thereon, with the radiation coating 10 being applied unilaterally on the carrier surface material 11 and thus forming an element front which faces a material to be heated, e.g. a person in the room. As can furthermore be understood from FIG. 2, a contact protection layer 12 is applied to the radiation coating 10, the former being in comparison with the latter preferably relatively thin; the radiation coating 10, on the one hand, being electrically insulated against contact and, on the other hand, enabling the emission of the oscillation spectrum without or, at most with only minor attenuation.

In contrast, the carrier surface material 11 as the element's reverse side, electrically insulates, on the one hand, the radiation coating 10 against contact and, on the other hand, prevents the emission of the oscillation spectrum entirely or at least with considerable attenuation. More specifically, the radiation coating 10 comprises binding agent, insulator, dispersing agent, water and graphite as follows:

a) 35 to 45% by weight graphite, and
b) 55 to 65% by weight of a base material that comprises:
  18 to 23% insulator,
  18 to 24% dispersing agent,
  12 to 16% distilled water, and
  39 to 49% binding agent, said binding agent comprising:
    64 to 79% distilled water,
    4 to 6% sulfonated oil,
    0.15 to 0.24% phenols, or 0.05 to 0.5% amount benzisothiazolinone,
    15 to 19% casein,
    0.8 to 1.2% urea,
    2 to 3% alkaline thinning agent, and
    2.5 to 3.5% caprolactam.

Exemplarily, the contact protection layer 12 here consists of an aqueous, finely dispersed, softener-free, medium viscosity copolymer dispersion of acrylic and metacrylic acid esters.

Moreover, FIG. 2 shows the emission of the oscillation spectrum represented by arrows 13.

The radiation coating 10 and, after its firming up, the contact protection layer 12 as well, can each be blade spread onto the carrier surface material 11.

The electrical contact from the electrical conductors 14, 15 (FIG. 1), designed as copper foil strips arranged in parallel, to the radiation coating 10 is achieved via a capacitive and/or inductive coupling, with the radiation coating 10 under or over the electrical conductors 14, 15, or, respectively, alternatively thereto, these being embedded in the radiation coating 10 which, however, is not illustrated here.

Thus, such an arrangement of the antenna radiation heaters 2 from a plurality of surface antenna elements 3 which are arranged within mutual reach will entirely preclude the risk of an electric shock upon contact with two or more surface antenna elements 3 by a technician.

After reading the foregoing, variations on my invention may become evident to those skilled in the art but my invention is limited only by the scope of the claims below:

I claim:

1. An antenna radiation heater for heating material using resonance comprising:

a) a plurality of antenna elements, each having a carrier surface material and a radiation coating applied thereon which is delimited by two spaced apart, parallel, electrical conductors with electrical contact as antenna limiters and from which high-frequency electromagnetic radiation can be emitted;

b) a harmonic generator coupled to the two electrical conductors of a surface antenna element for excitation of the radiation coating for the emission of an oscillation spectrum within the range of natural molecular frequencies of the matter to be heated; and c) a radiation coating applied unilaterally onto the carrier surface material to form an element front facing the material to be heated and a contact protection layer applied on the radiation coating which permits the emission of the oscillation spectrum without any or at most with only minor attenuation.

2. An antenna radiation heater according to claim 1, wherein the carrier surface material (11) as said elements' reverse side electrically insulates the radiation coating (10) against contact and prevents the emission of the oscillation spectrum therethrough entirely or at least with substantial attenuation.

3. An antenna radiation heater according to claim 1, wherein the contact protection layer (12) comprises an aqueous, finely dispersed, softener-free, medium viscosity copolymer dispersion of acrylic and methacrylic acid esters.

4. An antenna radiation heater according to claim 1, wherein the contact protection layer (12) comprises an aqueous, protective colloidal, medium viscosity polymer dispersion of vinyl acetate, versatic acid vinyl ester and maleic acid-di-n-butyl ester.

5. An antenna radiation heater according to claim 1, wherein the material of the radiation coating (10) comprises a binding agent, insulator, dispersing agent, water, and graphite as follows:

a) 35 to 45% by weight graphite, and b) 55 to 65% by weight of a base material that comprises:
- 18 to 23% insulator,
- 18 to 24% dispersing agent,
- 12 to 16% distilled water, and
- 39 to 49% binding agent, said binding agent comprising:
  - 64 to 79% distilled water,
  - 4 to 6% sulfonated oil,
  - 0.15 to 0.24% phenols, or 0.05 to 0.5% amount benzisothiazolinone,
  - 15 to 19% casein,
  - 0.8 to 1.2% urea,
  - 2 to 3% alkaline thinning agent, and
  - 2.5 to 3.5% caprolactam.

6. An antenna radiation heater according to claim 1, wherein the radiation coating (10) and, after its firming up, the contact protection layer (12) are formed by means of blade spreading.

7. An antenna radiation heater according to claim 1, wherein the harmonic generator as a component of a control/regulating device (7) comprises an electrical element which, upon contact with a control oscillation, shows a steep rate of current increase in accordance with a steep rising edge and thus is suitable for generating a high harmonic proportion.

8. An antenna radiation heater according to claim 1, wherein the electrical conductors are copper foil strips (14, 15) arranged in parallel and the electrical contact for radiation coating (10) is a capacitive and/or inductive coupling, said contact with the radiation coating (10) selectively either lying under or over the copper foil strips (14, 15) or being embedded in the radiation coating (10).

9. An antenna radiation heater according to claim 1, wherein the several surface antenna elements (3) are arranged within mutual reach, electrically connected in parallel and excitable by means of a harmonic generator.

10. An antenna radiation heater according to claim 1, wherein all surface antenna elements (3) have an identical right-angled surface and are connected in parallel in a symmetrical arrangement with short lengths of supply lines.

* * * * *